US005855130A

United States Patent [19]

Rorabacher et al.

[11] Patent Number: 5,855,130

[45] Date of Patent: Jan. 5, 1999

[54] ADJUNCT ACTUATOR FOR VEHICLE DOOR LOCK

[75] Inventors: Thomas L. Rorabacher, Livonia; Robert J. Bridges, Jr., Clarkston; Dennis D. Schwaiger, Whitmore Lake, all of Mich.

[73] Assignee: Stoneridge, Inc., Warren, Ohio

[21] Appl. No.: 845,044

[22] Filed: Apr. 18, 1997

Related U.S. Application Data

[62] Division of Ser. No. 500,797, Jul. 11, 1995.

[51] Int. Cl.[6] ..... E05B 47/00

[52] U.S. Cl. ..... 70/277; 70/279; 74/89.18; 292/201

[58] Field of Search ..... 70/264, 277, 279, 70/280–282, DIG. 42; 74/89.18; 292/201, 336.3, DIG. 62, 142, 199

[56] References Cited

U.S. PATENT DOCUMENTS

| | | | |
|---|---|---|---|
| 4,223,927 | 9/1980 | Kobayashi et al. | 292/1 |
| 4,270,783 | 6/1981 | Sorensen et al. | 292/336.3 |
| 4,502,718 | 3/1985 | Sasaki et al. | 292/201 X |
| 4,573,723 | 3/1986 | Morita et al. | 70/279 X |
| 4,779,912 | 10/1988 | Ikeda et al. | 292/336.3 |
| 4,793,640 | 12/1988 | Stewart, Sr. | 292/201 |
| 4,905,532 | 3/1990 | Fukumoto et al. | 292/201 X |
| 4,966,266 | 10/1990 | Yamada et al. | 70/237 X |
| 5,020,838 | 6/1991 | Fukumoto | 292/201 |
| 5,072,975 | 12/1991 | Hamada et al. | 292/201 |
| 5,106,134 | 4/1992 | Thau | 292/216 |
| 5,131,292 | 7/1992 | Hundebøl | 74/665 H |
| 5,236,234 | 8/1993 | Norman | 292/201 |
| 5,511,838 | 4/1996 | Baughman et al. | 292/201 X |
| 5,615,564 | 4/1997 | Inoue | 70/279 |

FOREIGN PATENT DOCUMENTS

| | | | |
|---|---|---|---|
| 478013 | 4/1992 | European Pat. Off. | 70/277 |
| 287384 | 11/1989 | Japan | 70/277 |
| 4034190 | 2/1992 | Japan | 70/255 |

OTHER PUBLICATIONS

Handbook Encyclopedia of Engineering, p. 473, The Industrial Press, New York, 1928.

Hytrel Injection Molding Guide, pp. 5, 18, DuPont, 1997.

Delrin Design Guide—Module III, pp. 2, 8, 37, 57, DuPont, 1997.

Delrin Molding Guide, pp. 1 and 4, DuPont, 1997.

Plastics Chemistry and Technology, by Walter E. Driver, pp. 112, 216, published by Van Nostrand Reinhold Co., 1979.

*Primary Examiner*—Suzanne Dino Barrett

*Attorney, Agent, or Firm*—MacMillan, Sobanski & Todd, LLC

[57] ABSTRACT

An adjunct actuator including an electric actuator motor and associated gear train providing motive power for remotely operating an output arm of the adjunct actuator. A lost motion clutch mechanism is provided between the gear train and the output arm. The lost motion clutch mechanism includes a floating sector gear driven by the gear train. The sector gear rides upon an arcuate rail formed on the actuator frame. The sector gear is driven to a neutral position by a spring when the electric motor is deenergized. The spring of the adjunct actuator is not preloaded during assembly of the adjunct actuator. The sector gear is disposed to drive an arcuate carriage which is pivotally mounted on the actuator frame to move about a common rotational axis with the sector gear. A pair of driving faces of the sector gear are interposed between a pair of driven faces on the carriage in a manner providing lost motion between the sector gear and the carriage. The output arm of the adjunct actuator is operatively connected to the carriage for rotation therewith.

31 Claims, 3 Drawing Sheets

ADJUNCT ACTUATOR FOR VEHICLE DOOR LOCK

CROSS-REFERENCE TO RELATED APPLICATION

This application is a divisional of pending application Ser. No. 08/500,797 filed on Jul. 11, 1995, and assigned to the assignee of this application.

BACKGROUND OF THE INVENTION

This invention relates in general to power operated locks for door latch assemblies and in particular to an improved adjunct actuator structure for vehicle door locks.

Vehicles such as passenger cars are commonly equipped with individual latch assemblies which secure respective passenger and driver doors closed. Each latch assembly is typically provided with a manual latch actuating mechanism for unlatching the latch assembly from outside and inside the vehicle, for example, respective inner and outer door handles. Each latch assembly is also typically provided with an individual lock for preventing unauthorized opening of the vehicle door. These locks are typically operatively coupled to a key-operated mechanism for manually operating the lock from the exterior of the vehicle and provided with a manual mechanism for operating the lock from the interior of the vehicle, such as a respective sill button.

Furthermore these locks are commonly provided with a respective power actuator for operating the lock. Such actuators may be controlled by the actuation of a remote device such as an electrical switch located inside the vehicle or a hand held transmitter operatively coupled to the remote operating mechanism through a vehicle security system.

It has been a common practice to mount a vehicle door latch and the associated lock on a common frame to form a latch assembly, which is then fastened to the vehicle at the appropriate location. If power operation of the lock was to be provided for in certain models of a vehicle, a power lock actuator could be provided. If the power lock actuator is mounted on a separate actuator frame, which was then fastened to the vehicle at a location remote from the latch frame upon which the latch and lock were mounted, the power actuator is referred to as a remote lock actuator. The remote lock actuator was then operatively coupled to the lock by a rod or other linkage transmitting motion from the remote lock actuator to the lock. Such a connecting rod was often quite lengthy, relatively easy to damage during use or servicing of door components, and did not always permit optimum geometry in connecting to the lock on the latch assembly. Furthermore, such connecting rods are relatively vulnerable to manipulation by thieves reaching into the interior of vehicle doors with various tools, allowing the lock to be defeated.

More recently, power door locks have become a standard feature in some vehicles. This has lead to power lock actuators being designed which are mounted on the same frame as the latch and the associated lock. These are referred to as integrated door lock actuators. Integrated door lock actuators eliminate the lengthy connecting rod between the remote lock actuator and lock, but lack flexibility in application. Such an arrangement would be unsuitable for use in situations where a single design of latch assembly is to be used in a line of vehicles in which some models would have power lock actuation capability and some are to be strictly manually operated.

The power lock actuator should not interfere with manual operation of the lock when the power lock actuator is operatively connected to the lock mechanism of the latch assembly. It is known to provide lost motion in a power lock actuator so that when the lock mechanism of the latch assembly is manually operated, for example with a door lock key, not all of the movable components of the power lock actuator have to be manually back-driven. This lost motion feature reduces the operating effort required for manual operation of the lock mechanism. In order to provide this lost motion feature for a power actuator, the power actuators of the past have typically been provided with some sort of preloaded spring, which may be difficult to assemble during manufacture of the power actuator.

SUMMARY OF THE INVENTION

This invention relates to a power lock actuator mounted on a respective actuator frame. The power lock actuator includes an electric actuator motor and associated gear train providing motive power for remotely operating an output arm of the power lock actuator. A lost motion clutch mechanism is provided between the gear train and the output arm. The lost motion clutch mechanism includes a sector gear driven by the gear train. The sector gear rides upon an arcuate rail formed on the actuator frame. The sector gear is driven to a neutral position by a spring when the electric motor is deenergized. The spring of the power lock actuator is not preloaded during assembly of the power actuator. The sector gear is disposed to drive an arcuate carriage which is pivotally mounted on the actuator frame to move about a common rotational axis with the sector gear. A pair of driving faces of the sector gear are interposed between a pair of driven faces on the carriage in a manner providing lost motion between the sector gear and the carriage. The output arm of the power actuator is operatively connected to the carriage for rotation therewith.

The actuator frame is adapted to be mounted onto a latch frame of a vehicle door latch assembly which is provided with a lock. This type of power actuator is referred to as an adjunct actuator. The latch frame is provided with a first engagement member defining an axis. The actuator frame has a second engagement member fixed thereto which is adapted to engage the first engagement member. When the first and second engagement members are mated, movement of the actuator frame relative to the latch frame is limited to movement along the axis defined by the first engagement member. The actuator frame and the latch frame may be moved relative to one another to a coupled position in which the first and second engagement members are engaged and the power actuator is operatively coupled to the lock of the latch assembly. The actuator frame and the latch frame may also be moved relative to one another to an uncoupled position, in which the first and second engagement members are disengaged and the adjunct actuator is operatively uncoupled from the lock. A fastening member, which may be a spring loaded pawl, is provided to releasably hold the actuator frame and the latch frame in the coupled position.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
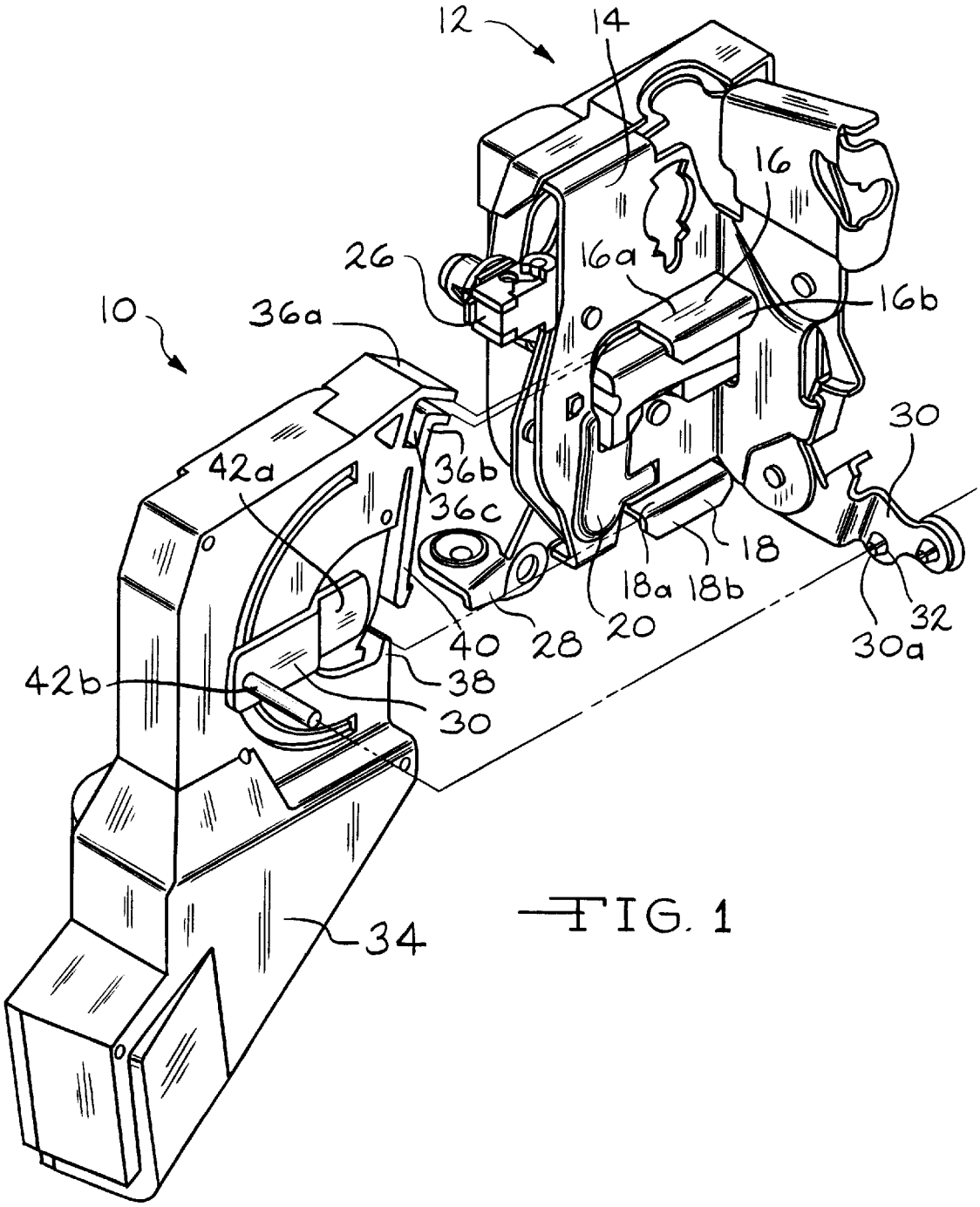
FIG. 1 is a perspective view of the adjunct actuator of this invention with the frame of the adjunct actuator uncoupled from the frame of an associated latch assembly.

In the following description of the invention, certain terminology will be used for the purpose of reference only, and are not intended to be limiting. Terms such as "upper", "lower", "above", "below", "rightward", "leftward", "clockwise", and "counterclockwise" refer to directions in the drawings to which reference is made. Terms such as "inward" and "outward" refer to directions toward and away from, respectively, the geometric center of the component described. Terms such as "radially inward" and "radially outward" refer to directions toward and away from, respectively, the rotational axis of the component described. Such terminology will include the words specifically mentioned above, derivatives thereof, and words of similar import.

Referring now to the drawings, there is illustrated in FIG. 1 an adjunct actuator of this invention, indicated generally at 10, and a conventional latch assembly 12, with which the adjunct actuator 10 may be used. As will be further described below, the adjunct actuator 10 is not mounted directly on the vehicle frame, separately from the latch assembly 12. The components of the adjunct actuator 10 are also not mounted on the latch assembly 12 frame as an integral part of the latch assembly 12. Instead the adjunct actuator 10 forms an adjunct to the latch assembly 12, in that the components of the adjunct actuator 10 are mounted on their own frame, which in turn is mounted on the frame of the latch assembly 12.

As indicated above, the latch assembly 12 includes a latch frame 14 upon which the components of the latch assembly 12 are mounted. The latch frame 14 includes a pair of spaced apart latch frame engagement members 16 and 18. The latch frame engagement member 16 includes a generally centrally located elongated flange 16*a* extending outwardly from the latch frame 14. The flange 16*a* is bent over along the length thereof to form a lip 16*b* which extends towards the latch frame engagement member 18. Thus the latch frame engagement member 16 generally has a cross section of an inverted "L" with respect to the latch frame 14. The latch frame engagement member 18 is also formed of an elongated flange 18*a*, having a lip 18*b* formed thereon, such that the latch frame engagement member 18 generally has a cross section of an inverted "L" with respect to the latch frame 14. The latch frame engagement member 18 is formed adjacent one edge of the latch frame 14. The lip 18*b* generally extends away from the latch frame engagement member 16.

The latch frame engagement members 16 and 18 are designed to cooperate with complementary actuator frame engagement members of an anti-tamper shield (not shown) for mounting the anti-tamper shield on the latch assembly 12. As is known, the purpose of the anti-tamper shield is to cover various components of the latch assembly 12 to prevent thieves from manipulating components thereof to unlock the door. A raised boss 20 is formed in the latch frame 14 adjacent the latch frame engagement member 16. The boss 20 may, of course, be separately formed of a suitable material and fixed to the latch frame 14. A spring finger (not shown) on the anti-tamper shield engages the boss 20 when the anti-tamper shield is installed on the latch frame engagement members 16 and 18 to lock the anti-tamper shield in place. The anti-tamper shield is removed by bending the spring finger to a position disengaged from the boss 20 and sliding the anti-tamper shield off the latch frame engagement members 16 and 18.

The latch assembly 12 also includes a latch fork (not shown) for engaging and, in cooperation with the latch frame 14, retaining a conventional latch bolt (not shown). A latch release lever 26 may be selectively operated to cause the latch fork to release the latch bolt. A first lock lever 28 may be operated between associated lock and unlock positions to respectively prevent and allow actuation of the latch release lever 26 to cause the latch fork to release the latch bolt. Similarly, a second lock lever 30 may be operated between associated lock and unlock positions to respectively prevent and allow actuation of the latch release lever 26 to cause the latch fork to release the latch bolt. The lock lever 30 is provided with an opening 30*a* therethrough, which may be used for a purpose which will be described below. As shown in FIG. 1, the opening 30*a* will preferably be provided with a plastic insert 32 fixed therein, the purpose of which will be explained below.

The adjunct actuator 10 includes a housing or actuator frame 34 upon which are mounted various components of the adjunct actuator 10, as will be described below. The actuator frame 34 is preferably molded of a suitable plastic material. The adjunct actuator 10 includes a pair of actuator frame engagement members 36 and 38 integrally formed in the actuator frame 34. The actuator frame engagement members 36 and 38 are complementary to the latch frame engagement members 16 and 18 of the latch assembly 12. The actuator frame engagement member 36 includes a pair of generally "L" shaped ribs 36*a* and 36*b* defining an "L" shaped notch 36*c* therebetween. The notch 36*c* is adapted to receive the latch frame engagement member 16 therein such that the latch frame engagement member 16 is captured between the ribs 36*a* and 36*b*, thereby preventing any movement therebetween except axial movement along the latch frame engagement member 16. Similarly, the actuator frame engagement member 38 is formed as a rib extending generally toward the actuator frame engagement member 36. The actuator frame engagement member 38 engages the lip 18*b* of the latch frame engagement member 18. In cooperation with the actuator frame engagement member 36 and the latch frame engagement member 16, the actuator frame engagement member 38 and the latch frame engagement member 18 prevent movement of the adjunct actuator 10 and the latch assembly 12 except along the latch frame engagement member 18.

A spring finger 40 is integrally formed on the actuator frame 34. The spring finger 40 engages the boss 20 of the latch assembly 12 when the adjunct actuator 10 is mounted on the latch frame engagement members 16 and 18 to lock the adjunct actuator 10 in place.

Figure 7:
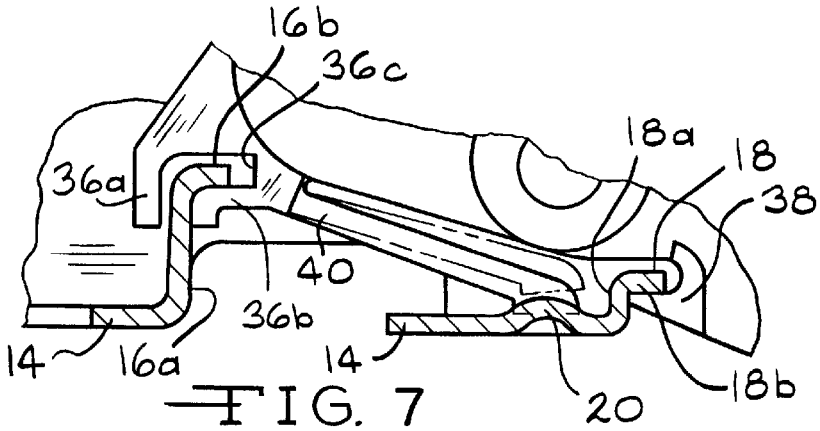
FIG. 7 is a partial sectional view of the adjunct actuator and latch assembly illustrated in FIG. 1, taken through the respective engagement members thereof illustrating the movement of a locking finger of the adjunct actuator.

Referring now to FIG. 7 in addition to FIG. 1, the adjunct actuator 10 may be mounted on the latch assembly 12 by first pressing spring finger 40 of the adjunct actuator 10 against the boss 20 of the latch assembly 12 so as to bend the spring finger 40 to a bent position as shown by the phantom line in FIG. 7. Next, the actuator frame engagement members 36 and 38 are aligned with the latch frame engagement members 16 and 18, respectively. Then, the adjunct actuator 10 is slid onto the latch frame engagement members 16 and 18 of the latch assembly 12. The actuator frame engagement members 36 and 38 cooperate with the respective latch frame engagement members 16 and 18 to prevent any movement of the adjunct actuator 10 relative to the latch assembly 12 except axial movement along the latch frame engagement members 16 and 18. When the actuator frame engagement members 36 and 38 have fully engaged the latch frame engagement members 16 and 18, the spring finger 40 will spring return to a straight position, as shown by the solid line in FIG. 7, capturing the spring finger 40 behind the boss 20. The spring finger 40 and the boss 20 will cooperate to prevent movement of the adjunct actuator 10 along the frame engagement members 16 and 18. Thus, the frame 34 of the adjunct actuator 10 is fixed to the frame 14 of the latch assembly 12. The adjunct actuator 10 may be removed from the latch assembly 12 by bending the spring finger 40 to the position disengaged from the boss 20 shown by the phantom line in FIG. 7. The adjunct actuator 10 can then be slid off the latch frame engagement members 16 and 18 of the latch assembly 12.

An output arm 42 is pivotally mounted at a first end 42*a* on the actuator frame 34. The output arm 42 may be formed of any suitable material, such as a metal like aluminum. A pin 42*b* extends perpendicularly from a second end of the output arm 42. The pin 42*b* extends through the opening 30*a* in the lock lever 30 of the latch assembly 12 when the adjunct actuator 10 is mounted on the latch assembly 12. As the adjunct actuator 10 is beings slid onto the latch frame engagement members 16 and 18 of the latch assembly 12, the pin 42*b* should be aligned with the opening 30*a* to cause the pin 42*b* to pass through the plastic insert 32 in the opening 30*a*. As will be further described below, the output arm 42 may be pivoted between lock and unlock positions when thus engaging the lock lever 30 to cause the lock lever 30 to be moved respectively between positions locking and unlocking the latch assembly 12. The plastic insert 32 prevents metal-to-metal contact between the pin 42*b* and the lock lever 30 to reduce wear of the metal parts.

Figure 2:
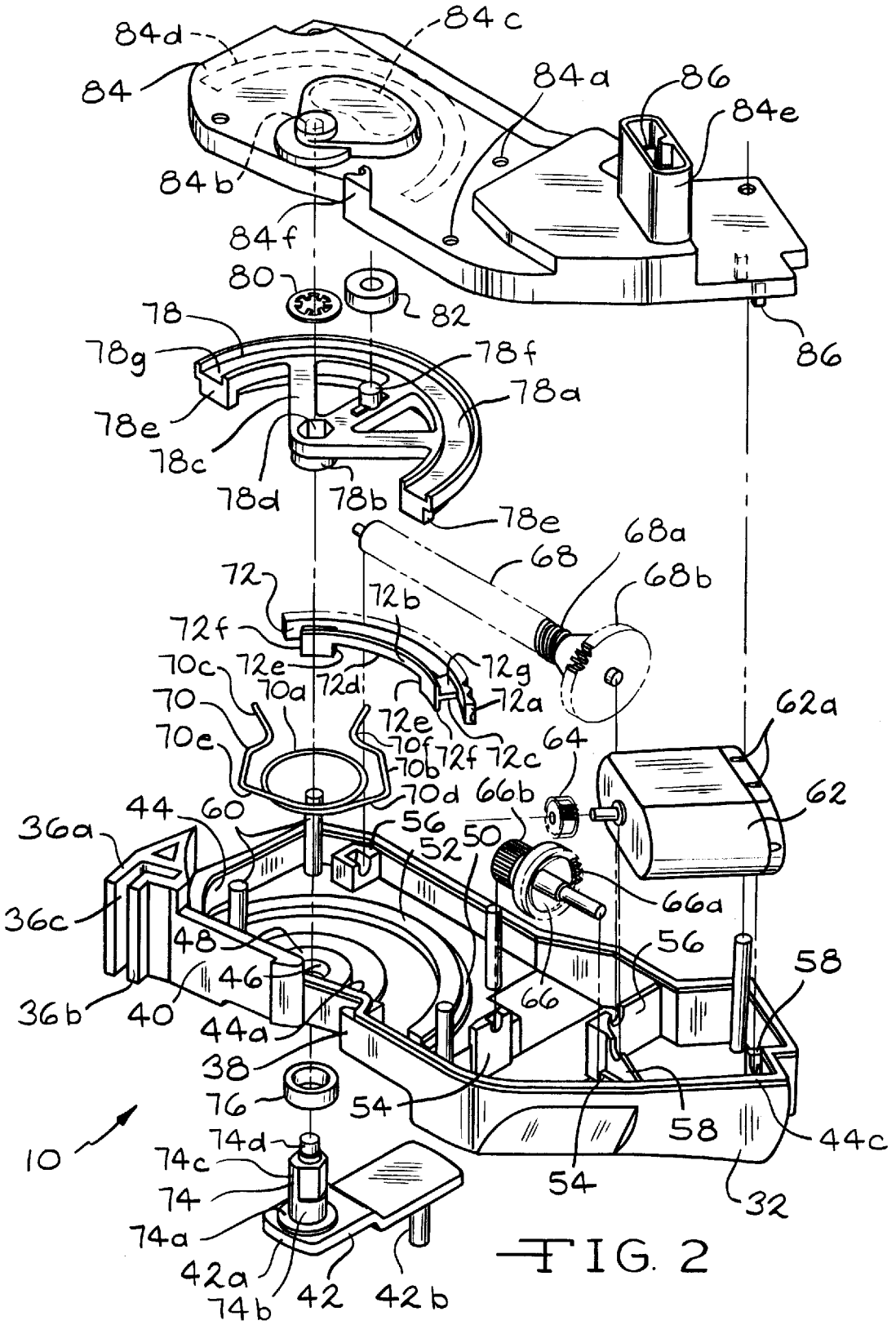
FIG. 2 is an exploded perspective view of the adjunct actuator illustrated in FIG. 1.

Referring now to FIG. 2, the adjunct actuator 10 is shown in an exploded view. As indicated above, the actuator frame 34 is preferably molded of a suitable plastic material. One plastic which may be used is polyethylene terephthalate (PET). As also indicated above, the actuator frame engagement members 36 and 38 and the spring finger 40 are integrally formed in the actuator frame 34. The actuator frame 34 also includes an upstanding peripheral wall 44. As best seen in FIGS. 3 through 6, the peripheral wall 44 includes a first portion having an inner face 44*a* and a second portion having an inner face 44*b*. The faces 44*a* and 44*b* are formed at a slight angle to one another in the shape of a "V", for a purpose which will be described below. Preferably, the actuator frame 34 is molded in a two-part process. The first step is to mold the actuator frame 34 structure of a suitable polymeric material. Before the actuator frame 34 has completely cured, and preferably while the actuator frame 34 is still retained in the mold cavity (not shown), a second material is molded onto the upper surface of the peripheral wall 44 of the actuator frame 34. The second material forms a strip 44*c* of a flexible elastomeric material on the top face of the peripheral wall 44, which serves as a permanently attached gasket as further described below. Preferably the strip 44*c* forms a continuous strip about the periphery of the actuator frame 34. One material which has been found to be suitable for forming the strip 44*c* is sold by E. I. duPont de Nemours & Company under the tradename HYTREL. HYTREL is a blocked copolymer consisting of a hard crystalline segment of polybutylene terephthalate and a soft amorphous segment based on long chain polyether glycols. Preferably, the first and second materials forming the actuator frame 34 and the strip 44*c* are chosen such that they will bond together during curing. However, it is contemplated that the second material may be adhered to the upper surface of the peripheral wall 44 by other means, such as through the use of a suitable adhesive. Preferably the strip 44*c* will have an inverted V-shape cross section, but of course may have other suitable cross sections as desired.

An opening 46 is defined through the actuator frame 34. The opening 46 is counterbored with a larger diameter opening lower section (not shown) and a reduced diameter upper section (visible in FIG. 2). A raised rib 48 is formed about the opening 46 on the upper surface of the actuator frame 34.

Formed on the upper surface of the actuator frame, in a semi-circular arc about the opening 46, is a stepped rib forming a lower track 50 and an upper track 52, the purpose of which will be discussed below. The rib is stepped because the radius of the outer face of the upper track 52 is less than the radius of the outer face of the lower track 50. The purpose of the lower track 50 and the upper track 52 will be discussed below. The rib forming the tracks 50 and 52 is centered on the opening 46, which is to say that all points along the arcuate line defined by the rib are equidistant from the center of the opening 46.

Also integrally formed on the upper surface of the actuator frame 34 are first and second pairs of gear nests, 54 and 56, respectively, and a pair of motor mounts 58. Each gear nest and motor mount has a U-shaped notch defined in the upper surface thereof to receive and support components which will be described below. A plurality of upstanding pins 60 are integrally molded on the upper surface of the actuator frame 34, the purpose of which will be described below.

A conventional electric motor 62 is mounted on the actuator frame 34, and located on the actuator frame 34 by engagement at either end thereof with the motor mounts 58. The motor 62 is preferably of the type having a pair of electrical sockets 62*a* provided on the upper surface thereof. A drive gear 64 is fixed to the shaft of the motor 62.

A face gear member 66 having a face gear 66*a* formed at one end and a spur gear 66*b* formed at the other end thereof is rotatably mounted in the first pair of gear nests 54. The face gear 66*a* meshes with the drive gear 64 on the shaft of the motor 62. The shaft of the motor 62 preferably forms an angle of about 45 to 75 degrees to the axis of rotation of the face gear member 66, and most preferably forms an angle of about 65 degrees thereto. It is contemplated that other suitable gear configurations, such as bevel and hypoid gears, may be used to connect the shaft of the motor 62 to the gear member 66 at the desired angle thereto.

A worm gear member 68 having an elongated worm 68*a* at one end and a spur gear 68*b* at the other end thereof is rotatably mounted in the second pair of gear nests 56. The axis of rotation of the worm gear member 68 is preferably parallel to the axis of rotation of the face gear member 66, and to the same side of the face gear member 66 as the motor 62 such that the axis of rotation of the worm gear member 68 may be extended through the motor. The spur gear 68*b* of the worm gear member 68 meshes with the spur gear 66*b* of the face gear member 66. The worm gear member 68 is thus operatively connected to the electric motor 62 through the face gear member 66 in a compact arrangement. Preferably, the axes of rotation of the gear members 66 and 68 and the shaft of the motor 62 lie in a single plane.

Figure 3:
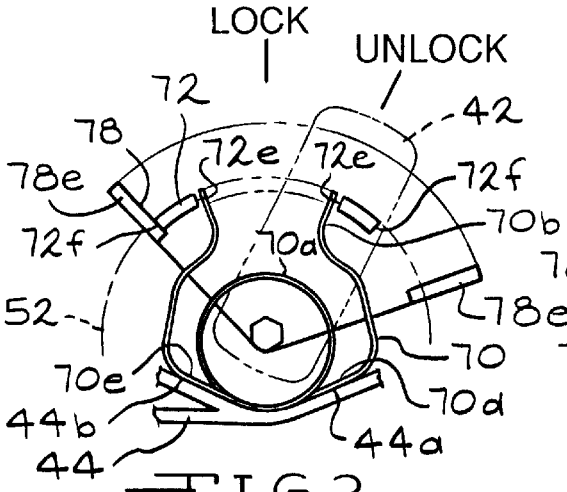
FIG. 3 is a schematic diagram of the adjunct actuator illustrated in FIG. 2 with an output arm thereof in an unlock position, and a sector gear thereof in a neutral position.
Figure 5:
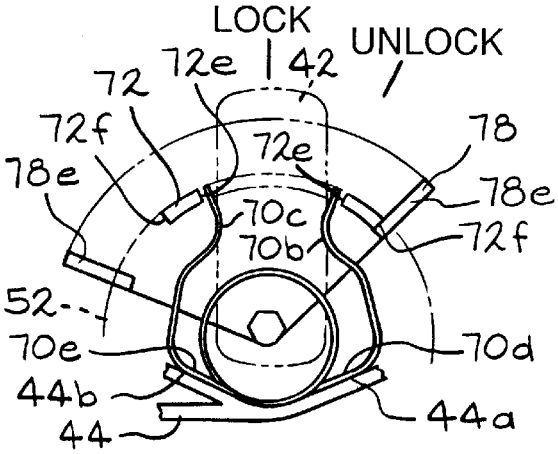
FIG. 5 is a view similar to that of FIG. 4, except showing the sector gear of the adjunct actuator in the neutral position thereof.

A wire spring 70 is mounted on top of the raised rib 48 about the opening 46 in the actuator frame 34. The spring 70 has a central looped section 70*a*, disposed about the opening 46, and a pair of arms 70*b* and 70*c*. As best seen in FIGS. 3 and 5, each of the arms 70*b* and 70*c* has a respective straight section, 70*d* and 70*e*, connected to the looped section 70*a*. The straight section 70*d* of the arm 70*b* lies adjacent the face 44*a* of the peripheral wall 44 of the actuator frame 34. Similarly, the straight section 70*e* of the arm 70*c* lies adjacent the face 44*b* of the peripheral wall 44 of the actuator frame 34. The straight sections 70*d* and 70*e* of the spring 70 form an angle which is about the same as the angle between the faces 44*a* and 44*b*, which serves to help properly orient the spring 70 on the actuator frame 34. The arm 70*b* has an S-shaped section 70*f*, which forms an outwardly hooked end portion. The arm 70*c* is a mirror image of the arm 70*b* , and thus also has an outwardly hooked end portion. The end portions of the arms 70*b* and 70*c* extend over the upper track 52 formed on the actuator frame 34.

An arcuate sector gear 72 is slidingly mounted on the upper track 52, and thus moves about a rotational axis defined through the opening 46 in the actuator frame 34. The sector gear 72 includes an arcuate outer flange 72*a* disposed adjacent the radially outer face of the upper track 52 and an arcuate inner flange 72*b* which is spaced radially inwardly from the outer flange 72*a* and disposed adjacent the radially inner face of the upper track 52. The outer flange 72*a* and the inner flange 72*b* are interconnected by a pair of spaced apart horizontal connecting webs 72*c*. Thus, the sector gear 72 has a generally H-shaped cross section through the connecting webs 72*c*. The sector gear 72 straddles the upper track 52 to prevent radial movement (toward or away from the axis of rotation) of the sector gear 72, while permitting the sector gear to slide along the upper track 52. The radially outer face of the sector gear 72 is provided with gear teeth which mesh with the worm 68*a* of the worm gear member 68. The lower edge of the inner flange 72*b* slides on the upper surface of the actuator frame 34. The lower edge of the outer flange 72*a* rides on the upper surface of the lower track 50, thereby vertically positioning the sector gear 72 for proper meshing with the worm 68*a*. The connecting webs 72*c* are preferably held slightly above the upper surface of the upper track 52 so as to minimize friction as the sector gear 72 slides along the upper track 52. The sector gear 72 may be referred to as a "floating" sector gear since it does not have a pivotally mounted hub portion. Instead, the sector gear 72 "floats" upon the tracks 50 and 52, and orbits or rotates about an axis of rotation which does not pass through the sector gear 72. It is contemplated, however, that alternate embodiments of the invention exist in which the sector gear 72 may be provided with a hub, and may be pivotally mounted upon a pin passing through the hub thereof. It is also contemplated that in such alternate embodiments the sector gear 72 may be replaced with a circular gear rather than the arcuate sector gear 72 of the illustrated embodiment. Thus it should be understood that the term sector gear as used in this application refers to any shaped gear, unless specifically indicated otherwise.

Preferably, the sector gear 72 rotates in the plane defined by the axes of rotation of the gear members 66 and 68 and the shaft of the motor 62, and is disposed on the same side of the axis of rotation of the worm gear member 68 as the face gear member 66. Thus, preferably, the axis of rotation of the face gear member 66 can be extended into the path of movement of the sector gear 72. This arrangement has been found to be surprisingly compact.

A notch 72*d* is defined in the lower portion of the inner flange 72*b* of the sector gear 72, thus forming a pair of spaced apart vertical faces 72*e*. These faces 72*e* are disposed adjacent to respective ones of the hooked arms 70*b* and 70*c* of the spring 70, thus capturing the arms 70*b* and 70*c* in the notch 72*d* for a purpose which will be described below. The ends of the inner flange 72*b* form a pair of drive faces 72*f*, the purpose of which will be described below. Finally the upper surface of the connecting webs 72*c* cooperate with the opposed faces of the outer flange 72*a* and inner flange 72*b* to define a guide notch 72*g* in the upper surface of the sector gear 72.

The output arm 42 is pivotally mounted in the opening 46 in the actuator frame 34 by means of a pin 74 extending upwardly from the first end 42*a* thereof. The pin 74, like the pin 42*b*, is preferably formed as an integral part of the output arm 42. A seating surface 74*a* is formed about the base of the pin 74, the purpose of which will be described below. A cylindrical section 74*b* of the pin 74 extends up through the opening 46 in the actuator frame 34. An engagement section 74*c* of the pin 74 extends upwardly out of the opening 46, above the raised rib 48 formed about the opening 46. Preferably the engagement section 74*c* has an asymmetric cross section for a purpose which will be discussed below. For example, in the illustrated embodiment, the engagement section 74*c* has a hexagonal cross section, except that one of the six sides of the engagement section 74*c* is rounded rather than flat. The purpose of such an asymmetric cross section will be discussed below. The pin 74 terminates in an upper cylindrical section 74*d* which may be of somewhat reduced diameter when compared to the subjacent engagement section 74*c*.

An elastomeric seal 76 provides a leak-proof seal between the pin 74 and the interior surface of the opening 46 in the actuator frame 34. The seal 76 is seated within the lower enlarged diameter portion of the opening 46. The seating surface 74*a* of the pin 74 bears against the lower surface of the seal 76, thereby retaining the seal 76 in place.

An arcuate carriage 78 is fixed to the asymmetric engagement section 74*c* of the pin 74. The carriage includes an arcuate outer rim 78*a* connected to a central hub 78*b* by a plurality of spokes 78*c*. The lower surface of the rim 78*a* is fitted in the arcuate guide notch 72*g* defined on the top of the sector gear 72 with a sliding fit, such that the sector gear 72 and the carriage 78 can rotate relative to one another about the vertical axis defined through the opening 46 in the actuator frame 34.

The hub 78*b* of the carriage 78 has a vertical opening 78*d* defined therethrough. The opening 78*d* preferably has an asymmetric cross section which mates with the asymmetric engagement section 74*c* of the pin 74 to prevent relative rotational movement between the carriage 78 and the output arm 42. The matching asymmetry of the opening 78*d* and the engagement section 74*c* ensures that the carriage 78 will be properly oriented relative to the output arm 42 when the carriage 78 is assembled thereon. Thus the carriage 78 and the output arm 42 are connected for rotation with one another about the vertical axis defined through the opening 46 in the actuator frame 34.

A respective lug 78*e* extends downwardly at each end of the arcuate outer rim 78*a* of the carriage 78. The inner flange 72*b* of the sector gear 72 is disposed between the lugs 78*e*. With the pin 74 of the output arm 42 as a vertex, the angle subtended by the inner flange 72*b* of the sector gear 72 between the drive faces 72*f* thereof is less than the angle subtended between the opposed inner faces of the pair of lugs 78*e* formed on said carriage 78. Thus, as will be further described below, the drive faces 72*f* of the sector gear 72 cooperate with the lugs 78*e* of the carriage 78 to provide a lost motion operative connection between the sector gear 72 and the carriage 78.

The carriage 78 also includes a vertically extending pin 78*f* formed on the upper surface of one of the spokes 78*c*. An arcuate guide notch 78*g* is defined in the upper surface of the carriage 78. The purpose of the pin 78*f* and the guide notch 78*g* will be described below.

A retaining ring 80 is pressed onto the upper cylindrical section 74*d* of the pin 74 on the output arm 42 to retain the carriage 78 on the pin 74.

An elastomeric annular bumper 82 is fitted onto the pin 78*f* on the upper surface of the carriage 78. The purpose of the bumper 82 will be explained below.

An upper cover 84 is mated to the upper surface of the peripheral wall 44 of the actuator frame 34. The strip 44*c* of flexible material on the upper surface of the peripheral wall 44 seals against the lower surface of the upper cover 84. A plurality of openings 84*a* are formed through the upper cover 84, each of which receives a corresponding one of the pins 60. During assembly, with the upper cover 84 pressed against the actuator frame 34 to compress the strip 44*c*, the upper ends of the pins 60 are enlarged to secure the cover 84 to the actuator frame 34. The upper ends of the pins 60 may have this enlarged head formed thereon by any common method such as orbital forming, heat staking, or ultrasonic heating. Preferably, the method used results in the pins 60 sealing the openings 84*a*. In this manner, with any cracks between the actuator frame 34 and the cover 84 sealed by the strip 44*c*, and the pin 74 on the output arm 42 sealed to the actuator frame 34 by the seal 76, the cover 84 and the actuator frame 34 cooperate to form a leak-tight enclosure which excludes dust and other contaminants from the components mounted therein. Any suitable lubricants which may be used on the components mounted therein would also be retained in such a leak-tight enclosure.

As shown in phantom line in FIG. 2, the cover 84 defines a cylindrical cavity 84*b* in the lower surface thereof which receives the upper cylindrical section 74*d* of the pin 74 on the output arm 42 to support the pin 74 for rotation therein. The cover 84 also defines an arcuate cavity 84*c* which receives the bumper 82 therein. As the carriage 78 is pivoted with the output arm 42, the bumper 82 engages the inner surfaces of the cavity 84*c* to limit further movement of the carriage 78. The bumper 82 compresses when the carriage 78 drives the bumper 82 against the inner surface of the cavity 84*c*, thereby limiting the shock to the carriage 78 and other components of the adjunct actuator 10 which are in motion therewith.

A guide track 84*d* extends downwardly from the lower surface of the cover 84, and extends in an arc about the cavity 84*b*, and thus about the axis defined by the opening 46 through the actuator frame 34. The guide track 84*d* engages the upper guide notch 78*g* on the carriage 78 with a slip fit, such that the guide track 84*d* helps support and guide the pivoting movement of the carriage 78. In another embodiment (not shown) the adjunct actuator 10 does not have a guide track 84*d* on the cover or an upper guide notch 78*g*. In this alternate embodiment, the carriage 78 is guided in its pivoting movement only by the pin 74 on the output arm 42 and by sliding engagement of the guide notch 72*g* on the upper surface of the sector gear 72.

The cover 84 also defines a socket 84*e* within which are the upper ends of a pair of electrical conductors 86. The pair of electrical conductors 86 are preferably insert molded in the cover 84 such that the lower end of each conductor 86 is aligned with a respective one of the sockets 62*a* of the electric motor 62, and inserted into the respective socket 62*a* when the cover 84 is assembled onto the actuator frame 34.

The cover 84 preferably defines a rib 84*f* which forms a portion of the actuator frame engagement member 38. The rib 84*f* extends the effective length of the actuator frame engagement member 38, and therefore increases the stability of the attachment between the latch assembly 12 and the adjunct actuator 10. The cover 84 also is formed with a plurality of downwardly extending flanges (not shown). These depending flanges mate with the upper surfaces of the gear nests 54 and 56 and the motor mounts 58 to rotatably secure the components mounted therein in the U-shaped notches formed in the upper surfaces of the gear nests 54 and 56 and the motor mounts 58.

Referring now to FIGS. 3 through 6, the operation of the adjunct actuator 10 will now be explained. As shown in FIG. 3, the output arm 42 is in the unlock position thereof, with the lock lever 30 (FIG. 1) therefore being in the unlock position thereof. The electric motor 62 (FIG. 2) is deenergized and the spring 70 is keeping the sector gear 72 in a neutral position. Note that the spring 70 is uncompressed when the sector gear 72 is in the neutral position. Although the arms 70*b* and 70*c* of the spring may engage the vertical faces 72*e* of the notch 72*d* in the sector gear 72, it may be preferable to provide a spring 70 in which the arms 70*b* and 70*c* are spaced somewhat closer together to facilitate insertion of the spring 70 in the notch 72*d*, as shown in FIG. 3. A spring 70 in which the arms 70*b* and 70*c* are spaced closer together than would allow the arms 70*b* and 70*c* to engage the vertical faces 72*e* of the notch 72*d* would thus be in an uncompressed free state when the sector gear 72 is in the neutral position, and thus would not be subject to any preload. As the term is used in this application, a spring is in an uncompressed free state when the spring is free of preload, that is, the spring is not subject to external forces tending to compress or extend the spring.

If desired, the latch assembly 12 may be locked manually by moving the lock lever 30 to the lock position thereof. This will cause the output arm 42 and the carriage 78 to move counterclockwise to their respective lock position, as shown in FIG. 5. However the clockwise lug 78*e* on the carriage 78 stops just as the lug 78*e* reaches the clockwise drive face 72*f* of the sector gear 72, as also shown in FIG. 5. The movement of the carriage 78 from the unlock to the lock position thereof does not cause the sector gear 72 to move from the neutral position. Thus the effort required to manually lock the latch assembly 12 is little greater than if the adjunct actuator 10 were not attached at all, since the only components of the adjunct actuator 10 that have to move during manual operation of the latch assembly 12 are the output arm 42 and the carriage 78. Because of the lost motion connection between the sector gear 72 and the carriage 78, there is no back-driving of the electric motor 62 through the gear members 66 and 68 and the sector gear 72, which would significantly increase the force required to manually lock the latch assembly 12.

Figure 4:
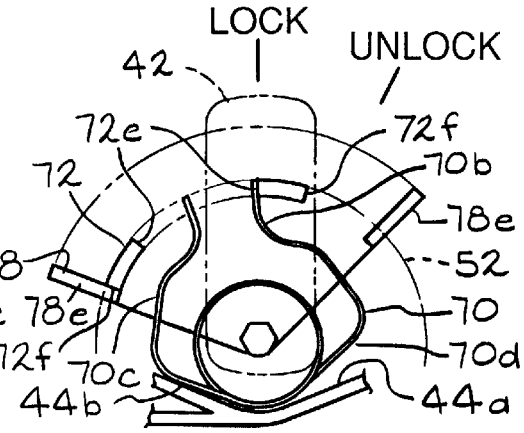
FIG. 4 is a view similar to that of FIG. 3, except showing the output arm and sector gear of the adjunct actuator in respective lock positions.

When it is desired to lock the latch assembly 12 using the adjunct actuator 10, starting from the unlocked condition illustrated in FIG. 3, the electric motor 62 is energized to drive the sector gear 72 counterclockwise from the neutral position illustrated in FIG. 3 to a lock position illustrated in FIG. 4. The drive face 72*f* of the sector gear 72 drives against the counterclockwise lug 78*e* of the carriage 78, causing the carriage 78 to be rotated counterclockwise to the lock position thereof. Simultaneously, the clockwise vertical surface 72*e* of the sector gear 72 engages the arm 70*b* of the spring 70 and urges the arm 70*b* to rotate counterclockwise. The straight section 70*e* of the spring 70 bears against the face 44*b* of the peripheral wall 44 on the actuator frame 34, resisting counterclockwise rotation of the spring 70. Thus the sector gear 72 compresses the spring arm 70*b* counterclockwise toward the straight section 70*e* of the spring 70. The bumper 82 engages the counterclockwise surface of the cavity 84*c*, stopping the carriage 78 and the sector gear 72 when the carriage 78 is in the lock position and, therefore, the output arm 42 and the lock lever 30 are in the lock position. The electric motor 62 is then deenergized. The spring 70 decompresses, with the arm 70*b* thereof urging the sector gear 72 to rotate clockwise back to the neutral position thereof, as shown in FIG. 5. Of course, as the sector gear 72 rotates back to the neutral position, it back-drives the gear members 66 and 68 and the electric motor 62. However, the energy used for this is energy from the electric motor 62 which is stored in the spring 70, and not manual energy supplied by the user. When the spring 70 returns the sector gear 72 to the neutral position thereof, the sector gear 72 stops just as the clockwise drive face 72*f* reaches the clockwise lug 78*e* on the carriage, and thus the spring-driven sector gear 72 does not cause the carriage 78 to move out of the lock position.

The latch assembly 12 may be manually unlocked from the position illustrated in FIG. 5 by moving the lock lever 30 to the unlock position thereof. This will cause the output arm 42 and the carriage 78 to move clockwise to their respective unlock position, as shown in FIG. 3. However the counterclockwise lug 78*e* on the carriage 78 stops just as the lug 78*e* reaches the counterclockwise drive face 72*f* of the sector gear 72, as also shown in FIG. 3. The movement of the carriage 78 from the lock to the unlock position thereof does not cause the sector gear 72 to move from the neutral position.

Figure 6:
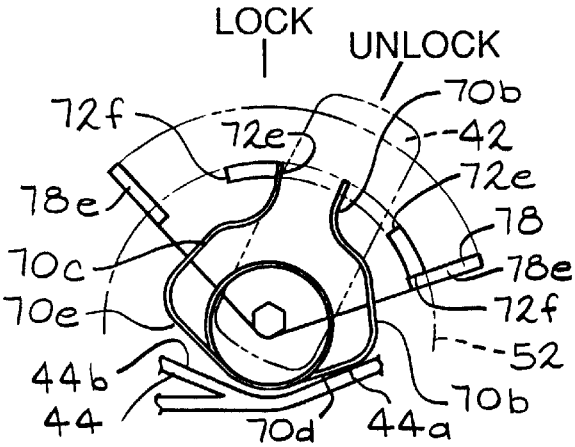
FIG. 6 is a view similar to that of FIG. 3, except showing both the output arm and the sector gear of the adjunct actuator in the unlock position thereof.

When it is desired to unlock the latch assembly 12 using the remote unlock actuator 10, starting from the locked condition illustrated in FIG. 5, the electric motor 62 is energized to drive the sector gear 72 clockwise from the neutral position illustrated in FIG. 3 to the unlock position illustrated in FIG. 6. The clockwise drive face 72*f* of the sector gear 72 drives against the clockwise lug 78*e* of the carriage 78, causing the carriage 78 to be rotated clockwise to the unlock position thereof Simultaneously, the counterclockwise vertical surface 72*e* of the sector gear 72 engages the arm 70*c* of the spring 70 and urges the arm 70*c* to rotate clockwise. The straight section 70*d* of the spring 70 bears against the face 44*a* of the peripheral wall 44, resisting clockwise rotation of the spring 70. Thus the sector gear 72 compresses the spring arm 70*c* clockwise toward the straight section 70*d* of the spring 70. The bumper 82 engages the clockwise surface of the cavity 84*c*, stopping the carriage 78 and thus the sector gear 72 when the carriage 78 is in the unlock position. The output arm 42 and the lock lever 30 are thus also moved to the unlock position. The electric motor 62 is then deenergized. The spring 70 decompresses, with the arm 70*c* thereof urging the sector gear 72 to rotate counterclockwise back to the neutral position thereof, as shown in FIG. 3, backdriving the electric motor 62. When the sector gear 72 is returned to the neutral position thereof, the sector gear 72 stops just as the counterclockwise drive face 72*f* reaches the counterclockwise lug 78*e* on the carriage, as shown in FIG. 3.

The principle and mode of operation of this invention have been explained and illustrated in its preferred embodiment. However, it must be understood that this invention may be practiced otherwise than as specifically explained and illustrated without departing from its spirit or scope.

What is claimed is:

1. An adjunct vehicle lock actuator comprising:

an electric motor;

a sector gear operatively driven by said motor and rotatable between a sector gear lock position, a sector gear unlock position, and a neutral position therebetween, said sector gear having first and second spaced-apart spring engagement faces;

a carriage engagable with said sector gear and rotatable between a carriage lock position and a carriage unlock position, said carriage connected to said sector gear by a lost motion connection permitting said carriage to move between said carriage lock and carriage unlock positions when said sector gear is in said neutral position, and requiring said carriage to be in said carriage lock position when said sector gear is in said sector gear lock position and requiring said carriage to be in said carriage unlock position when said sector gear is in said sector gear unlock position, said carriage connectable to a lock actuating arm of a vehicle door lock for rotation therewith; and a spring having a first gear engagement surface disposed adjacent said first spring engagement face of said sector gear and a second gear engagement surface disposed adjacent said second spring engagement face of said sector gear, at least one of said first gear engagement surface and said second gear engagement surface being spaced apart from the adjacent one of said first spring engagement face and said second spring engagement face when said sector gear is in said neutral position such that said spring is in an uncompressed free state, said spring being compressed to urge said sector gear toward said neutral position when said sector gear is in said sector gear lock position or said sector gear unlock position.

2. The adjunct actuator of claim 1 wherein said carriage includes an output arm fixed to an arcuate carriage member, said output arm being connectable to a lock actuating arm of a vehicle door lock for rotation therewith.

3. An adjunct vehicle lock actuator comprising:

a frame having a pin extending perpendicularly thereto defining an axis of rotation and a member fixed to said frame and defining an arc centered on said axis of rotation;

an electric motor mounted upon said frame;

a sector gear operatively driven by said motor and rotatable between a sector gear lock position, a sector gear unlock position, and a neutral position therebetween, said sector gear being slidingly mounted upon said member and engaging an arcuate portion of said member so as to be constrained to arcuate motion by said member about said axis of rotation;

a carriage mounted on said pin and pivotal relative to said frame about said axis of rotation between a carriage lock position and a carriage unlock position, said carriage connected to said sector gear by a lost motion connection permitting said carriage to move between said carriage lock and carriage unlock positions when said sector gear is in said neutral position, and requiring said carriage to be in said carriage lock position when said sector gear is in said sector gear lock position and requiring said carriage to be in said carriage unlock position when said sector gear is in said sector gear unlock position; and a spring operatively connected to said sector gear which urges said sector gear toward said neutral position, and drives said sector gear to said neutral position when said motor is deenergized.

4. The adjunct vehicle lock actuator defined in claim 3 wherein said carriage includes a pair of spaced apart lugs formed thereon, said lugs subtending a first angle having said axis of rotation as a vertex, and wherein said sector gear includes a pair of driving faces which are interposed between said pair of lugs, said driving faces subtending a second angle with said axis of rotation as a vertex which is less than said first angle.

5. The vehicle lock actuator defined in claim 3 wherein said sector gear includes an arcuate outer flange, an arcuate inner flange spaced radially inwardly from said outer flange with respect to said axis of rotation, and a web interconnecting said inner and outer flanges.

6. The vehicle lock actuator defined in claim 5 wherein said inner flange is disposed adjacent a radially inner face of said member and said outer flange is disposed adjacent a radially outer face of said member.

7. The vehicle lock actuator defined in claim 3 wherein said member is an arcuate rib.

8. The vehicle lock actuator defined in claim 3 wherein said member is integrally formed as a part of said frame.

9. An adjunct vehicle lock actuator comprising:

an output arm adapted to be connected to a vehicle lock and movable between a lock position in which the vehicle lock is locked and an unlock position in which the vehicle lock is unlocked;

a sector gear operatively connected to said output arm and movable on a path to move said output arm between said lock and unlock positions;

a worm gear member having a worm at a first end thereof which meshes with said sector gear and having a second gear at a second end thereof, said worm gear member being rotatable about a first axis of rotation;

a gear member having a first gear at a first end thereof and a second gear at a second end thereof which meshes with said second gear of said worm gear member, said gear member being rotatable about a second axis of rotation parallel to said first axis of rotation, said gear member being disposed on the same side of said first axis of rotation as said sector gear such that said second axis of rotation can be extended into the path of movement of said sector gear; and a motor having a shaft defining a third axis of rotation and having a drive gear fixed thereto, said drive gear meshing with said first gear of said gear member, said third axis of rotation forming an angle with said second axis of rotation of between 45 and 75 degrees.

10. The adjunct vehicle lock actuator defined in claim 9 wherein said first axis of rotation and said second axis of rotation define a plane, said third axis of rotation lying within said plane.

11. The adjunct vehicle lock actuator defined in claim 10 wherein said third axis of rotation forms an angle with said second axis of rotation of about 65 degrees.

12. The adjunct vehicle lock actuator defined in claim 9 wherein said third axis of rotation forms an angle with said second axis of rotation of about 65 degrees.

13. The adjunct vehicle lock actuator defined in claim 9 wherein said path of movement of said sector gear lies within a plane defined by said first axis of rotation and said second axis of rotation.

14. The adjunct vehicle lock actuator defined in claim 13 wherein said third axis of rotation lies within said plane.

15. The adjunct vehicle lock actuator defined in claim 14 wherein said third axis of rotation forms an angle with said second axis of rotation of about 65 degrees.

16. The adjunct vehicle lock actuator defined in claim 9 wherein said second gear of said gear member and said second gear of said worm gear member are spur gears.

17. A vehicle lock actuator comprising:

an output arm adapted to be connected to a vehicle lock for locking and unlocking said vehicle lock;

a gear operatively connected to said output arm and movable between a lock position in which said vehicle lock is locked, an unlock position in which said vehicle lock is unlocked, and a neutral position therebetween;

a motor operatively connected to said gear for moving said gear; and a spring positioned for moving said gear from said lock position to said neutral position and from said unlock position to said neutral position, wherein said spring is not subject to a preload when said gear is in said neutral position.

18. The vehicle lock actuator defined in claim 17 wherein said spring is positioned for urging a first surface of said gear to move said gear from said lock position to said neutral position, and said spring is positioned for urging a second surface of said gear to move said gear from said unlock position to said neutral position, wherein said spring is spaced apart from at least one of said first and second surfaces when said gear is in said neutral position.

19. The vehicle lock actuator defined in claim 18 herein said spring is positioned between said first and second surfaces.

20. The vehicle lock actuator defined in claim 17 wherein said gear is a sector gear.

21. The vehicle lock actuator defined in claim 17 wherein said actuator is an adjunct actuator.

22. A vehicle lock actuator comprising:

a motor having an output shaft;

a gear operatively connected to said output shaft;

a carriage engagable with said gear;

an output arm connected to said carriage and adapted to be connected to a vehicle lock, said output arm being movable between a lock position in which said vehicle lock is locked and an unlock position in which said vehicle lock is unlocked; and a guide member defining an arc and engaging portions of said gear to constrain said engaged portions of said gear to motion along said arc;

wherein said carriage is engaged with said gear during operation of said vehicle lock actuator, such that operation of said vehicle lock actuator causes movement of said output shaft of said motor, said gear, said carriage, and said output arm, to move said output arm between said lock position and said unlock position;

and wherein said carriage is disengaged from said gear during manual operation of said vehicle lock, such that manual operation of said vehicle lock causes movement of said output arm and said carriage, but does not cause movement of said gear and said output shaft of said motor.

23. The vehicle lock actuator defined in claim 22 wherein said carriage is connected to said gear by a lost motion connection so that said carriage is engaged with said gear during operation of said vehicle lock actuator, and said carriage is disengaged from said gear during manual operation of said vehicle lock.

24. The vehicle lock actuator defined in claim 22 additionally comprising a gear assembly connected between said gear and said output shaft of said motor;

wherein operation of said vehicle lock actuator causes movement of said output shaft of said motor, said gear assembly, said gear, said carriage, and said output arm, to move said output arm between said lock position and said unlock position;

and wherein manual operation of said vehicle lock causes movement of said output arm and said carriage, but does not cause movement of said gear, said gear assembly, and said output shaft of said motor.

25. The vehicle lock actuator defined in claim 22 wherein said actuator is an adjunct actuator.

26. The vehicle lock actuator defined in claim 22 wherein said gear is a sector gear.

27. An adjunct vehicle lock actuator comprising:

an output arm adapted to be connected to a vehicle lock and movable between a lock position in which the vehicle lock is locked and an unlock position in which the vehicle lock is unlocked;

a sector gear operatively connected to said output arm and movable on a path to move said output arm between said lock and unlock positions;

a worm gear member having a worm at a first end thereof which meshes with said sector gear and having a second gear at a second end thereof, said worm gear member being rotatable about a first axis of rotation;

a gear member having a first gear at a first end thereof and a second gear at a second end thereof which meshes with said second gear of said worm gear member, said gear member being rotatable about a second axis of rotation parallel to said first axis of rotation, said gear member being disposed on the same side of said first axis of rotation as said sector gear such that said second axis of rotation can be extended into the path of movement of said sector gear; and a motor having a shaft defining a third axis of rotation and having a drive gear fixed thereto, said drive gear meshing with said first gear of said gear member, said third axis of rotation forming an angle with said second axis of rotation.

28. The adjunct vehicle lock actuator defined in claim 27 wherein said third axis of rotation forms an angle with said second axis of rotation of between 45 and 75 degrees.

29. The adjunct vehicle lock actuator defined in claim 27 wherein said first axis of rotation and said second axis of rotation define a plane, said third axis of rotation intersecting said plane at a single point.

30. The adjunct vehicle lock actuator defined in claim 27 wherein said first axis of rotation and said second axis of rotation define a plane, said third axis of rotation lying outside of said plane.

31. The adjunct vehicle lock actuator defined in claim 27 wherein said first axis of rotation and said second axis of rotation define a plane, said third axis of rotation lying within said plane.

* * * * *